US006726496B1

(12) United States Patent
Reich et al.

(10) Patent No.: US 6,726,496 B1
(45) Date of Patent: Apr. 27, 2004

(54) ADAPTER FOR A DISCHARGE LAMP

(75) Inventors: Lajos Reich, Budapest; Zsolt Vincze, Döge; Zoltán Nagy, Gyula, all of (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/688,580

(22) Filed: Oct. 16, 2000

(51) Int. Cl.[7] ..... H01R 33/02; H01R 33/08
(52) U.S. Cl. ..... 439/227; 362/260; 362/216
(58) Field of Search ..... 439/227, 228, 439/229, 236; 362/260, 216

(56) References Cited

U.S. PATENT DOCUMENTS

| | | | | |
|---|---|---|---|---|
| 4,241,386 | A | 12/1980 | Dooley | 362/216 |
| 4,458,301 | A | 7/1984 | Chapman et al. | 362/216 |
| 4,549,251 | A | 10/1985 | Chapman et al. | 362/216 |

*Primary Examiner*—Brian Sircus
*Assistant Examiner*—Javaid Nasri

(57) ABSTRACT

An adapter (1) for a discharge lamp which comprises a socket portion (3) and a plug portion (5). The socket portion is suitable for receiving electrical contacts of a first discharge lamp which includes a discharge tube disposed substantially in a planar zone having a principal plane. The socket portion has an associated socket contacting plane where the socket contacting plane is defined as the principal plane of the discharge tube of the first discharge lamp when the latter is inserted into the socket portion. The plug portion is insertable into an external female socket which is suitable for receiving a second discharge lamp including a planar tube configuration. The plug portion also has an associated plug contacting plane. This plug contacting plane is defined as the principal plane of the tube configuration of the second discharge lamp when this latter is inserted into the external female socket. The adapter further comprises a connecting portion for connecting the socket portion and the plug portion. The connecting portion provides a substantially rigid connection between the socket portion and the plug portion so that the socket contacting plane substantially coincides with the plug contacting plane.

15 Claims, 7 Drawing Sheets

ADAPTER FOR A DISCHARGE LAMP

FIELD OF THE INVENTION

This invention relates to an adapter for a discharge lamp. The adapter is particularly suited for use with a discharge lamp in which a discharge tube is disposed substantially in a plane and a lamp support housing is substantially surrounded by the discharge tube.

BACKGROUND OF THE INVENTION

U.S. Pat. No. 4,241,386 discloses an adapter for a discharge lamp having a circular discharge tube, which surrounds a circular zone. The discharge lamp has a plug portion disposed on the peripheral region of the circular zone. Accordingly, this known adapter also comprises a socket portion matching the plug portion of the circular discharge lamp. The socket portion must be positioned in a peripheral region of the adapter in order to accommodate the circular discharge lamp.

Most mounting sockets receiving such circular low pressure discharge lamps (also called fluorescent lamps) have a socket portion which is situated in a peripheral area of the mounting socket, corresponding to the peripheral position of the plug portion of the circular discharge lamp.

U.S. Pat. Nos. 4,549,251 and 4,458,301 disclose a discharge lamp with a discharge tube where the discharge tube is bent in a shape so as to surround a substantially planar zone. The discharge lamp includes a lamp support housing. The lamp support housing is positioned in an substantially central area of the zone defined by the discharge tube. The lamp support housing comprises a plug portion with contact pins providing the electrical connection of the discharge lamp.

It would be desirable if discharge lamps of the type described in U.S. Pat. Nos. 4,549,251 and 4,458,301 were connectable to mounting sockets originally designed for circular lamps, i. e. for mounting sockets which have their socket portion in a peripheral area.

U.S. Pat. No. 5,471,375 teaches a mounting socket for use with a discharge lamp having a similar layout as those described in U.S. Pat. Nos. 4,549,251 and 4,458,301. The mounting socket comprises a socket portion matching the electric contacts of the discharge lamp, and also comprises a plug portion matching a known screw-type socket for incandescent lamps. Both the socket portion and the plug portion of the mounting socket are positioned in a central area of the discharge lamp when the discharge lamp is inserted in the mounting socket. However, when the mounting socket is placed in the screw-type socket of the incandescent lamp, and the discharge lamp is inserted in the mounting socket, the plane of the discharge lamp socket is above the level of the screw-type plug portion of the mounting socket. For this reason, a discharge lamp inserted in the mounting socket may interfere with the proper positioning of a lamp cover originally designed to cover a lamp inserted in the lower socket. Thus there is a particular need for a structure in which the level of the discharge lamp plug portion is not much higher than the plug portion of the mounting socket, and the plane of the discharge lamp is substantially the same as the plane of the original socket.

SUMMARY OF THE INVENTION

In an exemplary embodiment of the invention, an adapter for a discharge lamp comprises a socket portion suitable for receiving electrical contacts of a first discharge lamp. The first discharge lamp includes a discharge tube, which is disposed substantially in a planar zone having a principal plane. The socket portion has an associated socket contacting plane. The associated socket contacting plane is defined as the principal plane of the discharge tube of the first discharge lamp, when the latter is inserted into the socket portion of the adapter.

The adapter also comprises a plug portion which is insertable into an external female socket. The external female socket is of the type which is suitable for receiving a second discharge lamp, where the second discharge lamp has a discharge tube with a planar tube configuration. The plug portion of the adapter has an associated plug contacting plane. This plug contacting plane is defined by the principal plane of the tube configuration of the second discharge lamp, when the latter is inserted into the external female socket. The adapter further comprises a connecting portion for connecting the socket portion and the plug portion. The connecting portion provides a substantially rigid connection between the socket portion of the adapter and the plug portion of the adapter so that the socket contacting plane substantially coincides with the plug contacting plane.

The adapter is particularly suitable for discharge lamps which have a discharge tube surrounding a lamp support housing so that the lamp support housing is positioned in an substantially central area of the plane defined by the discharge tube. Such a lamp will be termed, folded lamp,, hereinafter because the ends of the discharge tube are folded inwards into the lamp support housing. The connecting portion of the adapter may be sized so that the plug portion is positioned in an substantially peripheral area of the plane defined by the discharge tube when the plug portion of the discharge lamp is inserted in the socket portion of the adapter. This allows discharge lamps with central plug portions to be used with mounting sockets and lamp housings which were designed for circular discharge lamps. Due to the fact that the plug contacting plane of the adapter coincides with the socket contacting plane, the principal plane of the discharge tube of the folded lamp will be practically in the same plane as the plane of the circular lamp. This means that the lamp covers originally designed for circular discharge lamps will be readily applicable with folded lamps as well.

DETAILED DESCRIPTION OF THE INVENTION

Figure 8:
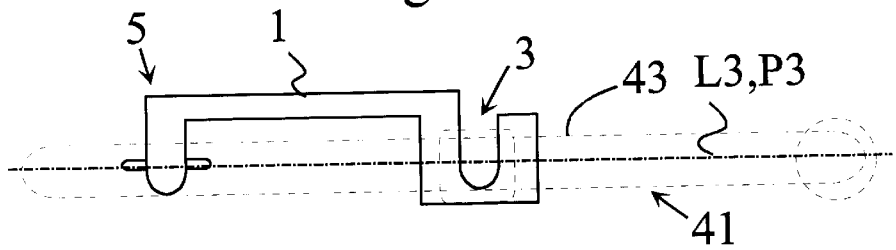
FIG. 8 illustrates the relative position of an adapter and a discharge lamp inserted into the adapter.

Referring now to FIGS. 1–8, there is shown an adapter 1 for a discharge lamp 41 while the discharge lamp 41 itself is shown only in FIG. 8. The adapter 1 comprises a female socket portion 3 for receiving the electrical contact pins of a discharge lamp. The socket portion 3 is of the type which is suitable for receiving the electrical contacts of a first discharge lamp 41 including a discharge tube 43. The discharge tube 43 of the first discharge lamp 41 is disposed substantially in a planar zone having a principal plane L3 as best seen in FIG. 8. The socket portion 3 has an associated socket contacting plane P3. This socket contacting plane P3 is defined as being equal to the principal plane L3 of the discharge tube 43 of the first discharge lamp 41 when the first discharge lamp 41 is in the inserted position in the socket portion 3 of the adapter 1. With other words, the socket contacting plane P3 is defined by the principal plane L3 of the discharge tube 43 of the first discharge lamp 41 when inserted into the socket portion 3.

Figure 1:
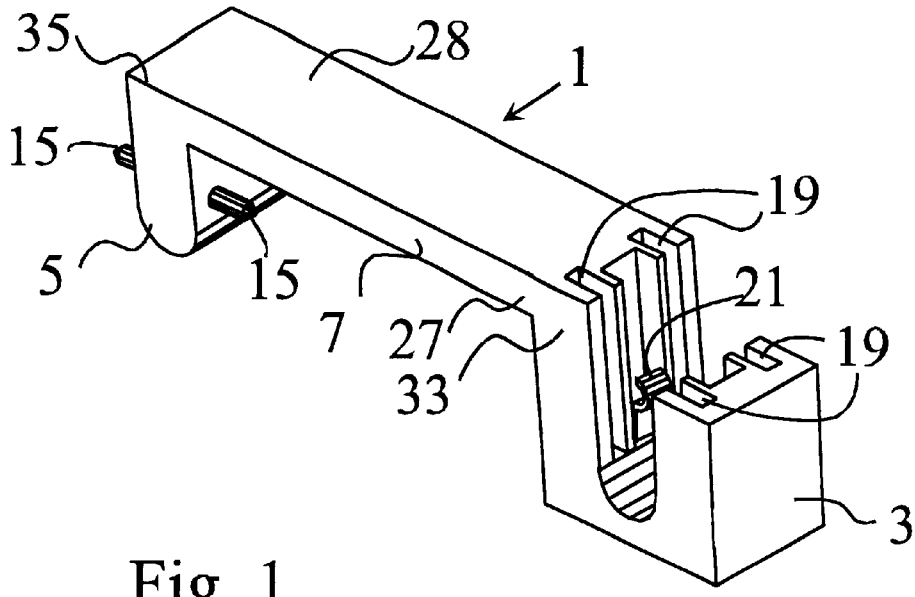
FIG. 1 is a perspective view of an adapter, in which the present invention is embodied, shown from above and from the side.
Figure 2:
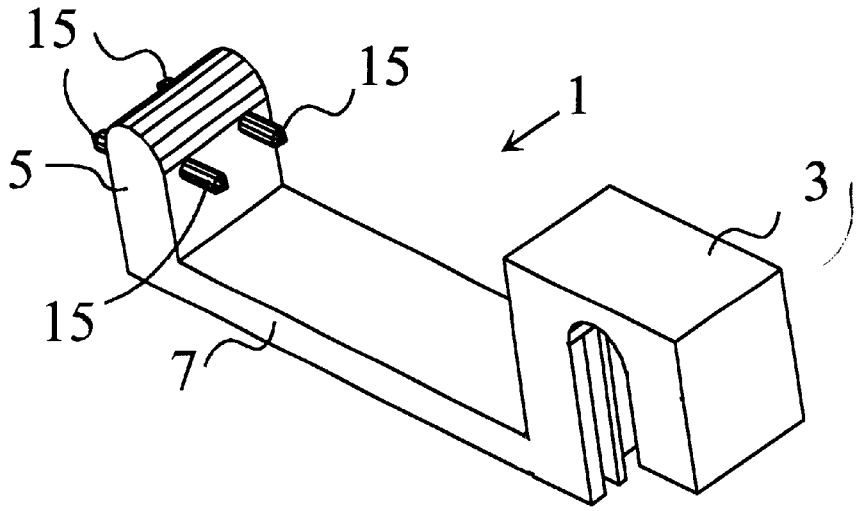
FIG. 2 is another perspective view of the adapter illustrated in FIG. 1 shown from below and from the side.
Figure 3:
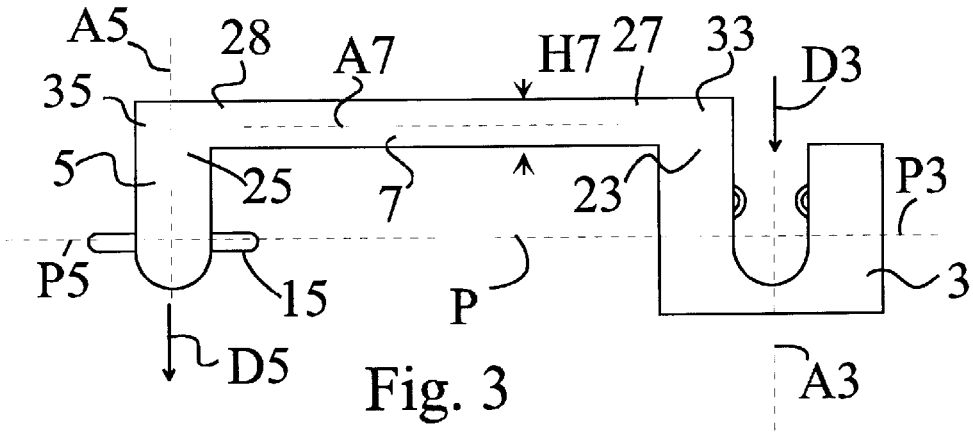
FIG. 3 is a side elevational view of the adapter shown in FIG. 1.

Typically, a socket of this type may receive a matching plug from a certain predetermined direction only. In this manner, the socket portion 3 also defines a socket inserting direction D3. As best seen in FIG. 3, in the embodiment of the adapter 1 as shown in FIGS. 1–8, the socket contacting plane P3 is substantially perpendicular to the socket inserting direction D3.

The adapter 1 also comprises a male plug portion 5. The male plug portion is equipped with contact pins 15. The plug portion 5 is designed to be inserted into an external female socket 39 for a second discharge lamp 31 (shown in FIG. 7). With other words, the plug portion 5 is insertable into an external female socket 39 suitable for receiving a second discharge lamp 31 where the second discharge lamp 31 also has a planar tube configuration. The plug portion 5 of the adapter 1 has an associated plug contacting plane P5. This plug contacting plane P5 is defined as being equal to the principal plane L5 of the tube configuration of the second discharge lamp 31 when the second discharge lamp 31 is in the inserted position in the external female socket 39. With other words, the plug contacting plane P5 is defined by the principal plane L5 of the tube configuration of the second discharge lamp 31 when inserted into the external female socket 39.

The plug portion 5 is of the type which may be inserted into the external socket 39 from a certain well-defined direction only. In this manner, the plug portion 5 also defines a plug inserting direction D5 in the same manner as explained above with reference to the socket inserting direction D3.

In the embodiment of the adapter as shown in FIGS. 1–8, the socket inserting direction D3 is parallel to the plug inserting direction D5 as it is best perceived from FIG. 3. From this, it follows that the plug contacting plane P5 is substantially perpendicular to the plug inserting direction D5.

The adapter 1 further comprises a connecting portion 7 which serves for connecting the socket portion 3 and the plug portion 5. The connecting portion 7 provides a substantially rigid connection between the socket portion 3 and the plug portion 5. As it is best seen in FIG. 3, the connecting portion is formed so that the socket contacting plane P3 substantially coincides with the plug contacting plane P5. This feature is also perceived when comparing FIGS. 7 and 8 with each other. In this manner, a common contacting plane P is defined (shown in FIG. 3).

It is also best seen in FIG. 3 that the socket portion 3 is displaced relative to the plug portion 5 parallel along the common contacting plane P. The amount of this displacement may depend on the different applications. In the embodiment shown in FIGS. 1–8, the distance between the central axis A3 of the socket portion 3 and the central axis A5 of the plug portion 5 is 133 millimeters.

The adapter is made of plastic and has metallic connector plates 13 and contact pins 15. The connector plates 13 and the contact pins 15 are connected with electrically conductive wires, typically of copper. The connecting portion 7 of the adapter 1 is formed as a straight bar with a longitudinal principal axis A7 parallel to the common contacting plane P. The cross section of the connecting portion 7 is a flat rectangle. The width W7 of the connecting portion 7 perpendicular to its longitudinal principal axis A7 and perpendicular to the socket inserting direction D3 is larger than the height H7 of the connecting portion 7. The height H7 is defined as a dimension perpendicular to the longitudinal principal axis A7 and parallel with the socket or plug inserting direction D3 and D5, respectively.

Figure 4:
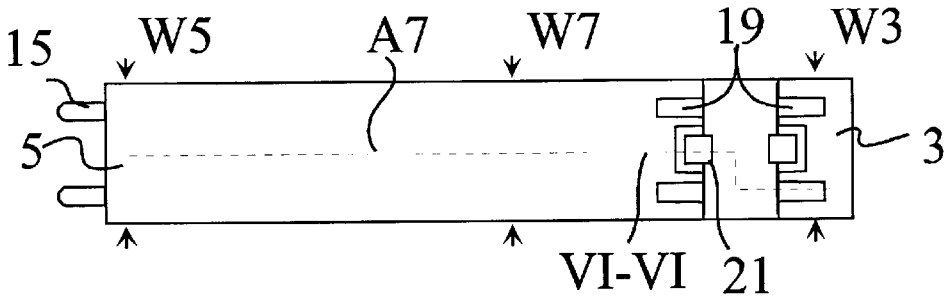
FIG. 4 is a top plan view of the adapter shown in FIG. 1.
Figure 5:
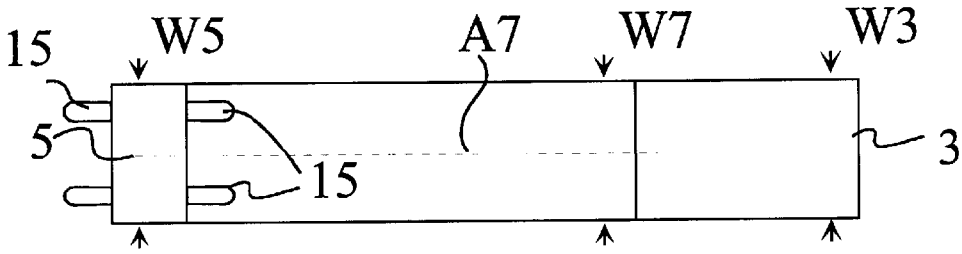
FIG. 5 is a bottom plan view of the adapter shown in FIG. 1.
Figure 6:
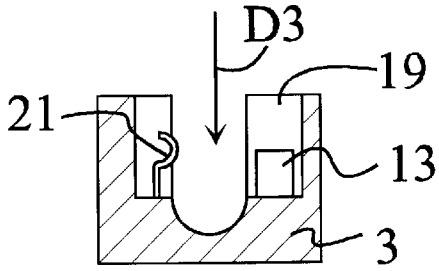
FIG. 6 is a cross-section taken along the line VI—VI of FIG. 4.
Figure 7:
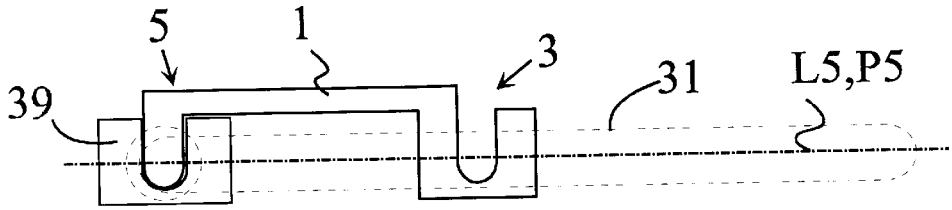
FIG. 7 is a side elevational view of the adapter shown in FIG. 1 when it is inserted into an external socket.

As it is best seen in FIGS. 4 and 5, the width W7 of the connecting portion perpendicular to its longitudinal principal axis A7 and perpendicular to the plug inserting direction D5 equals the width W5 of the plug portion 5. In the shown embodiments, the width W7 of the connecting portion 7 perpendicular to its longitudinal principal axis A7 and perpendicular to the socket inserting direction D3 also equals the width W3 of the socket portion 3.

The receiving end 23 of the socket portion 3 receiving a matching plug comprises an extension 33. The extension 33 is preferably at least as high as the height H7 of the connection portion. At the same time, the free end 25 of the plug portion 5, i. e. the end 25, which is not inserted into a socket, comprises an elevated portion 35. This elevated portion is sized so that it extends from a matching socket preferably at least as much as the height H7 of the connection portion 7 when the plug portion 5 is inserted into such a matching socket, e. g. the external female socket 39 (see FIG. 7). One end 27 of the connecting portion 7 connects to the extension 33 on the receiving end 23 of the socket portion 3. The other end 28 of the connecting portion 7 connects to the elevated portion 35 of the plug portion 5.

It will be appreciated that the definition of the various parts of the adapter is a functional definition only. In the shown embodiments, the adapter 1 is made of one piece of material, and its main parts, as the socket portion, the plug portion and the connecting portion constitute a single integral unit. However, it is also possible to make the adapter from distinct parts, and to attach them to each other with suitable fastening means.

In the shown embodiments, the plug portion 5 comprises four plug pins 15 extending perpendicularly sidewards relative to the plug inserting direction D5. At the same time, the socket portion 3 comprises four pin slots 19 for receiving four contacting pins. The principal plane of the pin slots 19 is parallel to the socket inserting direction D3. In a particularly advantageous embodiment, the plug portion 5 corresponds to a matching plug being receivable by the socket portion 3, and at the same time the socket portion 3 corresponds to a matching socket receiving the plug portion 5. With other words, the socket portion 3 and the plug portion 5 substantially conform to each other. In the presented embodiment, the socket portion 3 and the plug portion 5 fulfill the IEC 60901 standard.

The pin slots 19 of the socket portion 3 comprise electrical contacting means, e. g. connector plates 13 for contacting the pins of a matching plug inserted into the socket portion 3. There are retention springs 21 between the pin slots 19 in order to provide improved mechanical fastening of a plug inserted into the socket portion 3.

Figure 9:
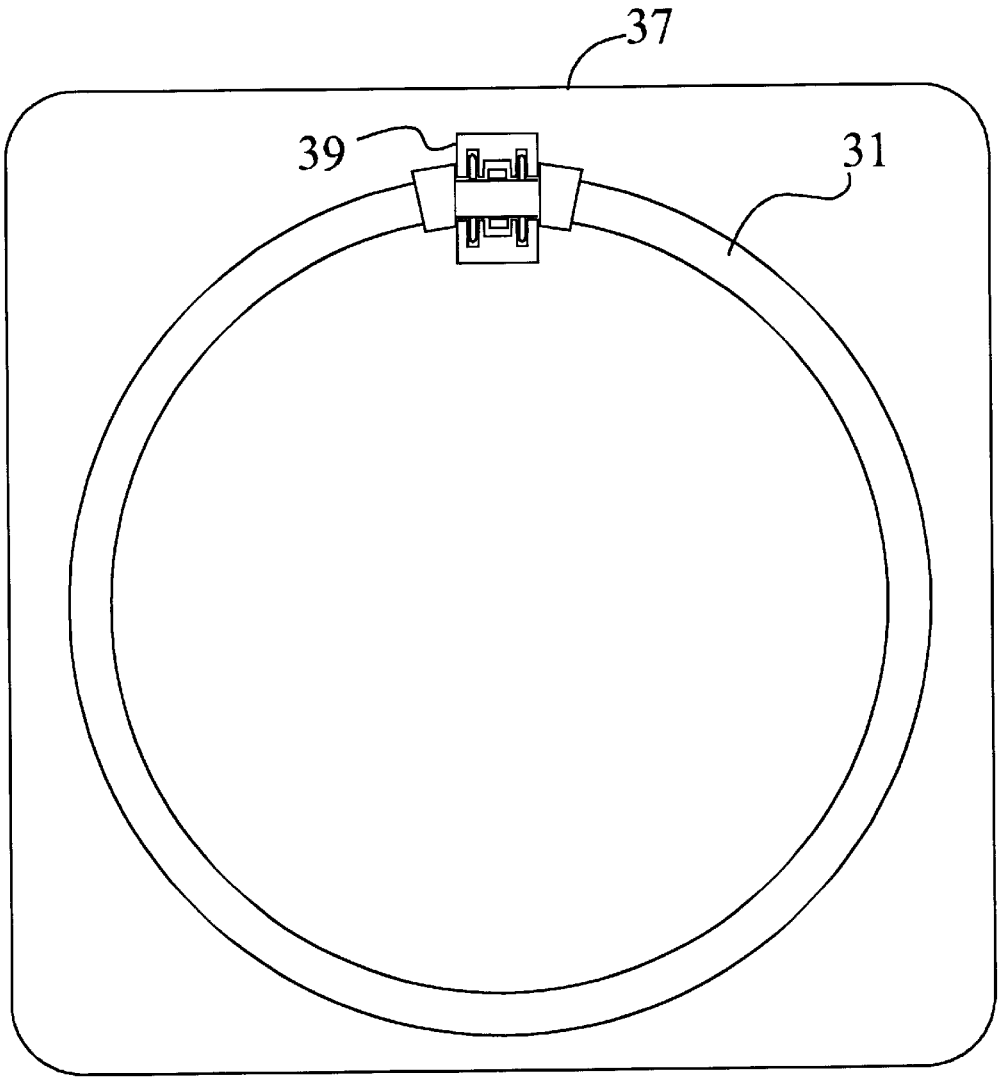
Fig. 9 PRIOR ART
FIG. 9 is a top plan view of a known lamp mounting socket and housing accommodating a known circular discharge lamp.

Turning now to FIG. 9, there is shown a known lamp housing 37 illustrated only schematically. The lamp housing 37 has a generally square base with rounded corners. Along an edge of the square, a female socket 39 holds the plug part of a circular discharge lamp 31. The socket 39 and the lamp 31 conform to the IEC 60901 standard.

Figure 10:
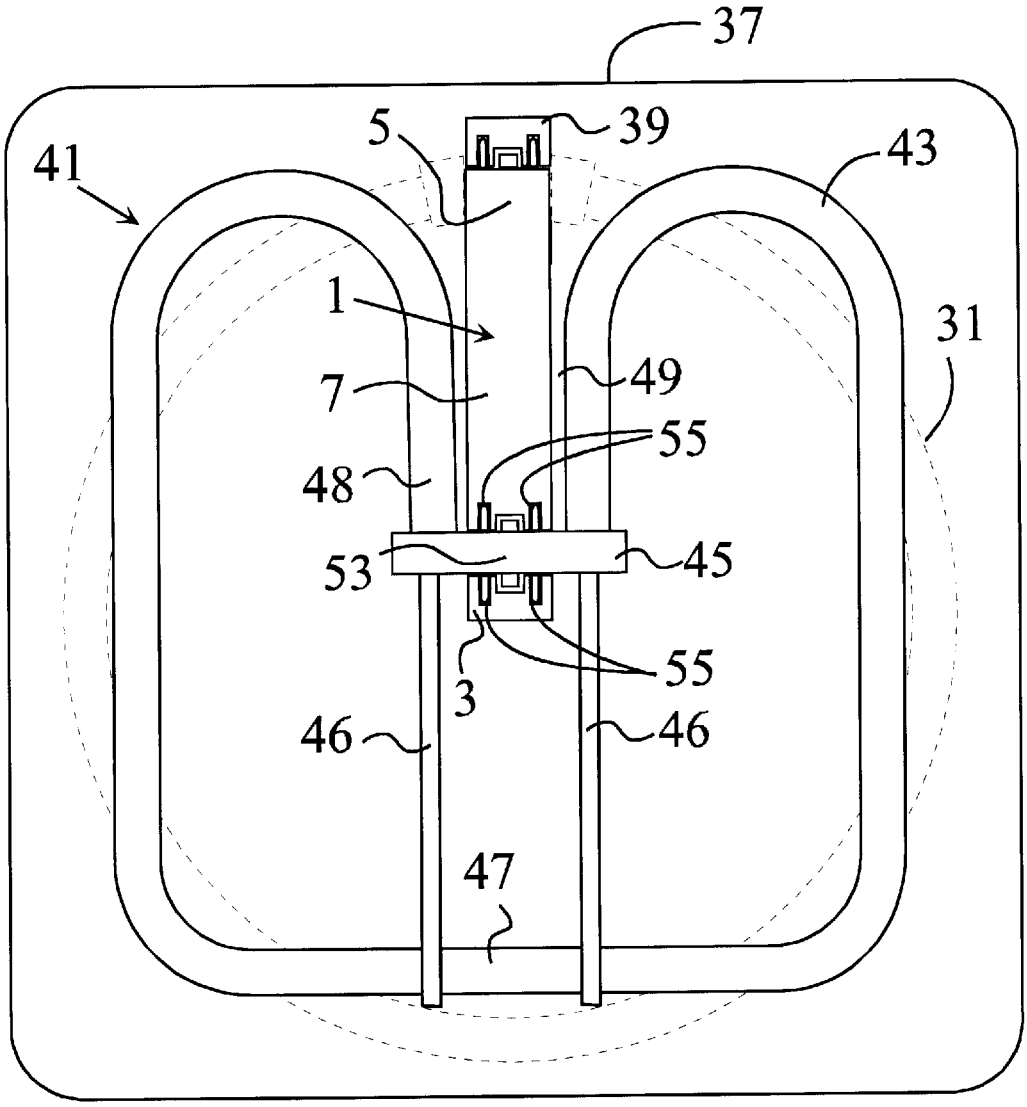
FIG. 10 is a top plan view of the lamp mounting socket and housing of FIG. which accommodates a folded lamp equipped with the adapter of FIG. 1.

Referring now to FIG. 10, there is shown an adapter 1 used with a discharge lamp 41. The discharge lamp 41 is of the type which has a discharge tube 43 and a lamp support housing 45. The discharge tube 43 is disposed substantially in a planar zone having a principal plane, and substantially surrounds the lamp support housing 45. The principal plane of the discharge tube 43 is parallel to the plane of the drawing in FIG. 10. The lamp support housing 45 is positioned substantially in an central area of the zone defined by the discharge tube 43. Extension legs 46 stabilize the position of the lamp support housing 45 relative to the middle section 47 of the discharge tube 43. The two supporting ends 48 of the discharge tube 43 bends inwards into the lamp support housing 45. There is a free space 49 of predetermined width between the two supporting ends 48 of the discharge tube 43. The lamp support housing 45 comprises a plug portion 53. This plug portion 53 has similar structure and dimensions as the plug portion 5 of the adapter 1 shown in FIGS. 1–6, and it is insertable in the socket portion 3 of the adapter 1. The plug portion 53 of the lamp 41 is equipped with contact pins 55 for providing the electrical connection for the discharge lamp 41. The contact pins 55 co-operate with the pin slots 19 of the adapter 1 and press against the contacts 13 (not shown in FIG. 10) when the plug portion 53 is inserted into the socket portion 3.

The lamp 41 is placed in the lamp housing 37 with the help of the adapter 1. As it is clearly seen in FIG. 10, the plug portion 5 of the adapter 1 is positioned in an essentially peripheral area of the planar zone defined by the discharge tube 43 of the lamp 41 when the plug portion 53 of the discharge lamp 41 is inserted in the socket portion 3 of the adapter 1. In this arrangement, the connecting portion 7 of the adapter is disposed in the free space 49 between the supporting ends 48 of the discharge tube 43, and the plug portion 5 of the adapter 1 is inserted into the female socket 39 of the lamp housing 37. In this manner, the folded discharge lamp 41 may be used with the lamp housing 37 without any further modification of the latter. The contours of a circular discharge lamp 31 are also shown (with dotted lines) for comparison.

Figure 11:
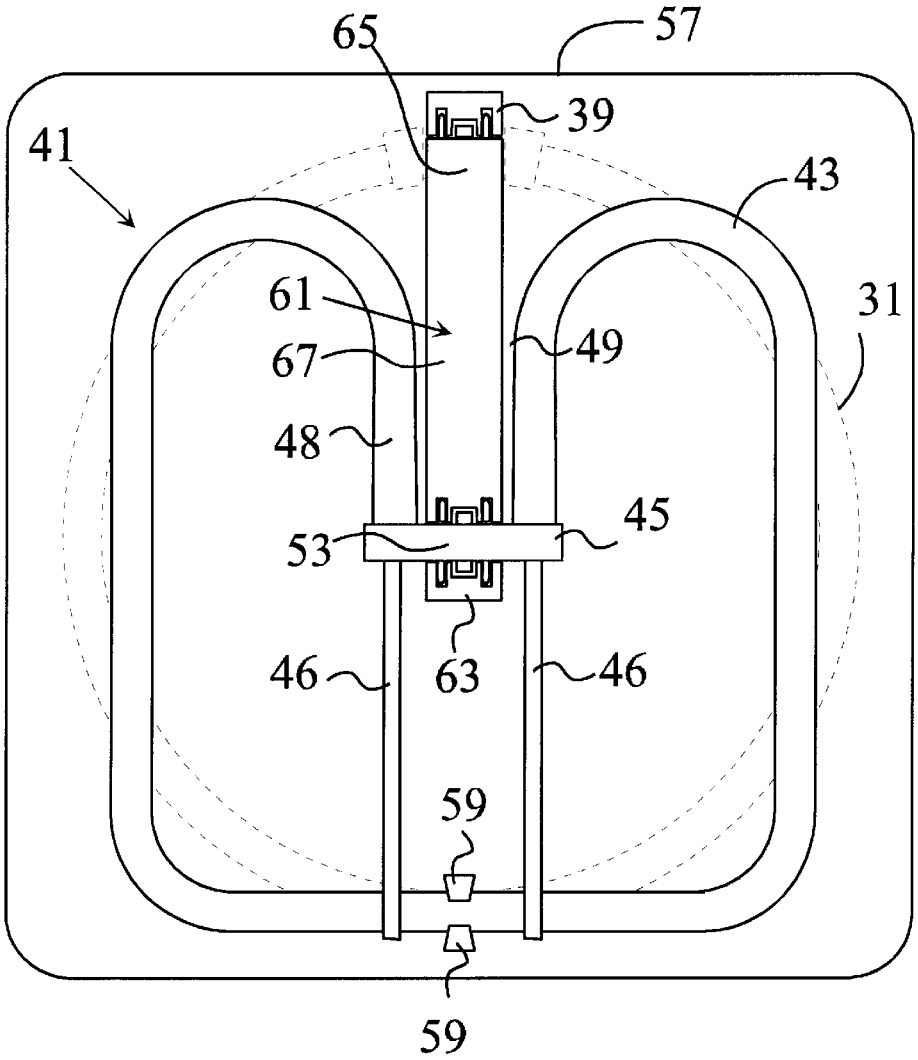
FIG. 11 is a top plan view of a lamp mounting socket and housing similar to the housing of FIG. 9 and accommodating a folded lamp equipped with a modified adapter.
Figure 12:
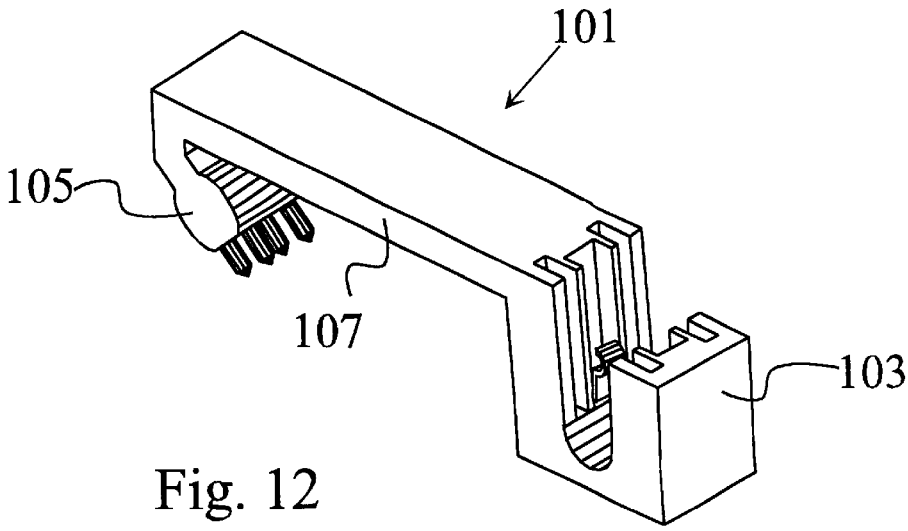
FIG. 12 is a perspective view of another adapter, in which the invention is further embodied, shown from above and from the side.
Figure 13:
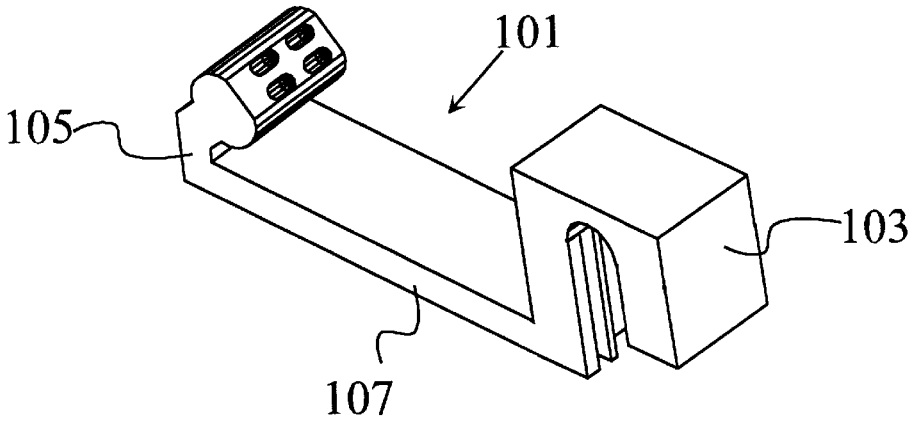
FIG. 13 is another perspective view of the adapter of in FIG. 12 shown from below and from the side.

With reference to FIG. 11, there is shown a lamp housing 57 which is a modified version of the lamp housing 37 of FIG. 10. Beside the female socket 39, the lamp housing 57 also comprises a pair of retention clips 59 opposite the socket 39. The retention clips 59 provide improved mechanical fastening for a circular discharge lamp 31 by holding the part of the discharge tube opposite to the socket portion of the discharge lamp 31.

In order to be able to utilise the retention clips 59, the adapter 61 shown in FIG. 11 is slightly longer than the adapter 1 shown in FIGS. 1–8. Otherwise, the two embodiments of the adapter has an identical structure. With this embodiment, the plug portion 65 of the adapter 61 extends slightly beyond the periphery of the planar zone defined by the discharge tube 43 of the lamp 41 when the plug portion of the discharge lamp 41 is inserted in the socket portion 63 of the adapter 61. In this case, the distance between the central axis of the plug portion 65 and the central axis of the socket portion 63 is 149,5 millimeters. As previously, in the arrangement of FIG. 11 the connecting portion 67 of the adapter 61 is disposed in the free space 49 between the supporting ends 48 of the discharge tube 43. This arrangement allows the folded discharge lamp 41 to be used with the modified lamp housing 57 without any further modification of the latter, and the improved fastening provided by the retention clips 59 is also maintained.

It is noted that the supporting ends 48 of the discharge tube 43 are not necessarily at the end of the discharge path within the discharge tube 43. Beside the supporting ends 48 of the discharge tube 43 which connect to the lamp support housing 45, the discharge tube 43 may comprise further ends which connect to the lamp support housing 45 in different locations.

Turning now to FIGS. 12–15, there is shown another adapter 101 in which the present invention is further embodied. The adapter is also designed to receive a discharge lamp 41 (the discharge lamp 41 itself is shown only in FIG. 15 with dotted lines). The adapter 101 comprises a female socket portion 103 for receiving the electrical contact pins of a discharge lamp 41. The socket portion 103 of the adapter 101 is identical to the socket portion 3 of the adapter 1 of FIGS. 1–8.

Accordingly, the socket portion 103 has an associated socket contacting plane P103. This socket contacting plane P103 is defined as being equal to the principal plane L3 of the discharge tube 43 of the first discharge lamp 41 when the first discharge lamp 41 is in the inserted position in the socket portion 103 of the adapter 101. With other words, the socket contacting plane P103 is defined by the principal plane L3 of the discharge tube 43 of the first discharge lamp 41 when inserted into the socket portion 103.

Figure 14:
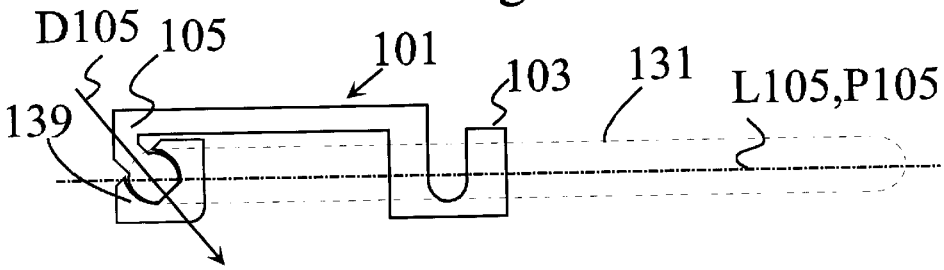
FIG. 14 is a side elevational view of the adapter shown in FIGS. 12 and 13 when it is inserted into an external socket.
Figure 15:
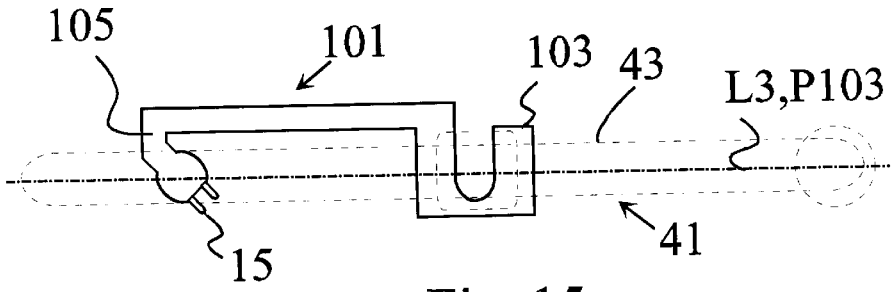
FIG. 15 illustrates the relative position of the adapter of FIGS. 12, 13 and a discharge lamp inserted into the adapter.

The adapter 101 also comprises a male plug portion 105. The male plug portion is equipped with contact pins 15. The plug portion 105 is designed to be inserted into an external female socket 139 for a second discharge lamp 131 (the discharge lamp 131 is shown in FIG. 14 with dotted lines only). With other words, the plug portion 105 is insertable into an external female socket 139 suitable for receiving a second discharge lamp 131 where the second discharge lamp 131 also has a planar tube configuration.

The plug portion 105 of the adapter 101 has an associated plug contacting plane P105. This plug contacting plane P105 is defined as being equal to the principal plane L105 of the tube configuration of the second discharge lamp 131 when the second discharge lamp 131 is in the inserted position in the external female socket 139. With other words, the plug contacting plane P105 is defined by the principal plane L105 of the tube configuration of the second discharge lamp 131 when inserted into the external female socket 139.

The plug portion 105 is also of the type which may be inserted into the external socket 139 from a certain well-defined direction only. In this manner, the plug portion 105 also defines a plug inserting direction D105 in the same manner as explained above with reference to the socket inserting direction D103.

In the embodiment of the adapter as shown in FIGS. 12–15, the plug portion 105 of the adapter 101 and the external socket 139 corresponds to a variant of the IEC 60061-2 standard where the plug contacting plane P105 is at an acute angle to the plug inserting direction D105 as best seen in FIG. 14. In this embodiment, the angle between the plug contacting plane P105 and the plug inserting direction D105 is 45 degrees. The plug portion 105 comprises four plug pins 15 which extend parallel to the plug inserting direction D105 toward the external socket 139. The socket 139 comprises matching bores (not shown) receiving the plug pins 15 of the plug portion 105. Suitable contact means are provided in the bores of the socket 139 in order to establish the necessary electric connection to the plug portion 105.

The adapter 101 also comprises a connecting portion 107 which serves for connecting the socket portion 103 and the plug portion 105. The connecting portion 107 provides a substantially rigid connection between the socket portion 103 and the plug portion 105. As it is best perceived by comparing FIGS. 14 and 15, the connecting portion 107 is formed so that the socket contacting plane P103 substantially coincides with the plug contacting plane P105.

The adapter 101 is used in the same manner as explained with reference to FIGS. 9–11, but the embodiment of FIGS. 12–15 is used with lamp housings which are equipped with sockets 139 according to the IEC 60061-2 standard.

What is claimed is:

1. An adapter for a discharge lamp comprising a socket portion suitable for receiving electrical contacts of a first discharge lamp including a discharge tube disposed substantially in a planar zone having a principal plane, the socket portion having an associated socket contacting plane, said socket contacting plane being defined by the principal plane of the discharge tube of the first discharge lamp when inserted into the socket portion, a plug portion insertable into an external female socket suitable for receiving a second discharge lamp including a planar tube configuration, the plug portion having an associated plug contacting plane, said plug contacting plane being defined by the principal plane of the tube configuration of the second discharge lamp when inserted into the external female socket, further comprising a connecting portion for connecting the socket portion and the plug portion, said connecting portion providing a substantially rigid connection between the socket portion and the plug portion so that said socket contacting plane substantially coincides with said plug contacting plane.

2. The adapter of claim 1 in which the socket portion has a socket inserting direction, the socket inserting direction being defined by the inserting direction of a matching plug when inserted into the socket portion, and the socket contacting plane is substantially perpendicular to the socket inserting direction.

3. The adapter of claim 1 in which the plug portion has a plug inserting direction, the plug inserting direction being defined by the inserting direction of the plug portion when inserted into a matching socket, and the plug contacting plane is at an acute angle to the plug inserting direction.

4. The adapter of claim 1 in which the plug portion has a plug inserting direction, the plug inserting direction being defined by the inserting direction of the plug portion when inserted into a matching socket, and the plug contacting plane is substantially perpendicular to the plug inserting direction.

5. The adapter of claim 1 in which the connecting portion is a straight bar having a longitudinal principal axis parallel to the plug contacting plane and the socket contacting plane.

6. The adapter of claim 5 in which the width of the connecting portion perpendicular to its longitudinal principal axis and to the plug inserting direction equals the width of the plug portion or the width of the socket portion.

7. The adapter of claim 1 in which an end of the socket portion receiving a matching plug comprises an extension, a free end of the plug portion comprises an elevated portion extending from a matching socket, and one end of the connecting portion connects to the extension on the receiving end of the socket portion, and the other end of the connecting portion connects to the elevated portion of the plug portion.

8. The adapter of claim 1 in which the plug portion comprises four plug pins extending perpendicularly sidewards relative to the plug inserting direction.

9. The adapter of claim 1 in which the socket portion comprises four pin slots for receiving four contacting pins, the pin slots having a principal plane parallel to the socket inserting direction.

10. The adapter of claim 1 in which the plug portion comprises four plug pins extending parallel to the plug inserting direction.

11. The adapter of claim 1 in which the plug portion corresponds to a matching plug receivable by the socket portion.

12. The adapter of claim 1 in which the socket portion corresponds to a matching socket receiving the plug portion.

13. A lamp-adapter arrangement comprising a first discharge lamp inserted in an adapter, the first discharge lamp having a discharge tube and a lamp support housing, the discharge tube disposed substantially in a planar zone having a principal plane, the lamp support housing comprising a lamp plug portion for providing electrical connection for the discharge lamp, the adapter comprising a socket portion suitable for receiving electrical contacts of the first discharge lamp, the socket portion having an associated socket contacting plane, said socket contacting plane being defined by the principal plane of the discharge tube of the first discharge lamp when inserted into the socket portion, a plug portion insertable into an external female socket suitable for receiving a second discharge lamp including a planar tube configuration, the plug portion having an associated plug contacting plane, said plug contacting plane being defined by the principal plane of the tube configuration of the second discharge lamp when inserted into the external female socket, the adapter further comprising a connecting portion for connecting the socket portion and the plug portion, said connecting portion providing a substantially rigid connection between the socket portion and the plug portion so that said socket contacting plane substantially coincides with said plug contacting plane.

14. The arrangement of claim 13 in which the lamp support housing is positioned in a substantially central area of the planar zone defined by the discharge tube, and the discharge tube substantially surrounds the lamp support housing, wherein the plug portion is positioned in a substantially peripheral area of the planar zone defined by the discharge tube when the plug portion of the first discharge lamp is inserted in the socket portion of the adapter.

15. The arrangement of claim 13 in which supporting ends of the discharge tube of the first discharge lamp are bent inwards into the lamp support housing to have a free space of predetermined width therebetween, and the connecting portion is disposed in the free space between the supporting ends of the discharge tube.

* * * * *